US005408802A

United States Patent [19]

Weder et al.

[11] Patent Number: 5,408,802

[45] Date of Patent: Apr. 25, 1995

[54] METHOD FOR WRAPPING A FLORAL GROUPING

[75] Inventors: Donald E. Weder, Highland, Ill.; Franklin J. Craig, Valley Park, Mo.; William F. Straeter, Breese; Joseph G. Straeter, Highland, both of Ill.

[73] Assignee: Highland Supply Corporation, Highland, Ill.

[21] Appl. No.: 261,700

[22] Filed: Jun. 17, 1994

Related U.S. Application Data

[63] Continuation of Ser. No. 968,702, Oct. 30, 1992, abandoned, which is a continuation of Ser. No. 865,504, Apr. 9, 1992, Pat. No. 5,239,804, which is a continuation of Ser. No. 658,413, Feb. 15, 1991, Pat. No. 5,111,637, which is a continuation of Ser. No. 391,463, Aug. 9, 1989, abandoned, which is a continuation-in-part of Ser. No. 249,761, Sep. 26, 1988, abandoned.

[51] Int. Cl.[6] ..... B65B 11/56; B65B 51/02; B65B 61/06

[52] U.S. Cl. ..... 53/397; 53/410; 53/411; 53/465

[58] Field of Search ..... 53/397, 399, 461, 465, 53/411, 419, 219, 141, 410; 156/213, 215; 427/429; 118/DIG. 17, 264, 268

[56] References Cited

U.S. PATENT DOCUMENTS

| | | | |
|---|---|---|---|
| 682,817 | 9/1901 | Shaner | 53/219 |
| 898,273 | 9/1908 | Silger et al. | 53/219 X |
| 1,525,015 | 2/1925 | Weeks | 53/461 X |
| 1,962,722 | 6/1934 | Krueger | 118/264 X |
| 2,294,670 | 9/1942 | Krueger | 118/268 X |
| 2,337,808 | 12/1943 | Ford | 118/268 |
| 2,540,090 | 2/1951 | Brackney | 53/219 X |
| 2,552,948 | 5/1951 | Ferrato | 118/264 X |
| 2,577,183 | 12/1951 | Denton | 156/399 |
| 3,271,922 | 9/1966 | Wallerstein et al. | 53/399 |
| 3,924,561 | 12/1975 | Ruthart et al. | 118/DIG. 17 X |
| 4,660,502 | 4/1987 | Scott | 118/DIG. 17 |

*Primary Examiner*—Horace M. Culver
*Attorney, Agent, or Firm*—Dunlap & Codding

[57] ABSTRACT

A material dispenser for dispensing sheets of material with an adhesive applied thereto. The material is passed through a material applicator and the material applicator includes a contact portion with adhesive in contact with a portion of the material for applying adhesive to the material. The material in one embodiment is a non-heat sealable, non-shape sustaining material and the material is wrapped about a floral grouping.

4 Claims, 4 Drawing Sheets

METHOD FOR WRAPPING A FLORAL GROUPING

CROSS-REFERENCE TO RELATED APPLICATIONS

The present application is a continuation of U.S. Ser. No. 968,702, filed Oct. 30, 1992, now abandoned; which is a continuation of U.S. Ser. No. 865,504, filed Apr. 9, 1992, now U.S. Pat. No. 5,239,804, which issued on Aug. 31, 1993; which is a continuation of U.S. Ser. No. 658,413, filed Feb. 15, 1991, now U.S. Pat. No. 5,111,637, issued May 12, 1992; which is a continuation of U.S. Ser. No. 391,463, filed Aug. 9, 1989, now abandoned; which is a continuation-in-part of U.S. Ser. No. 249,761, filed Sep. 26, 1988, now abandoned.

FIELD OF THE INVENTION

A material dispenser for dispensing sheets of material wherein a sheet of material is passed through an adhesive applicator for applying an adhesive to at least a portion of the sheet of material, the sheet of material being used for wrapping a floral grouping.

DESCRIPTION OF THE PREFERRED EMBODIMENTS

Figure 1:
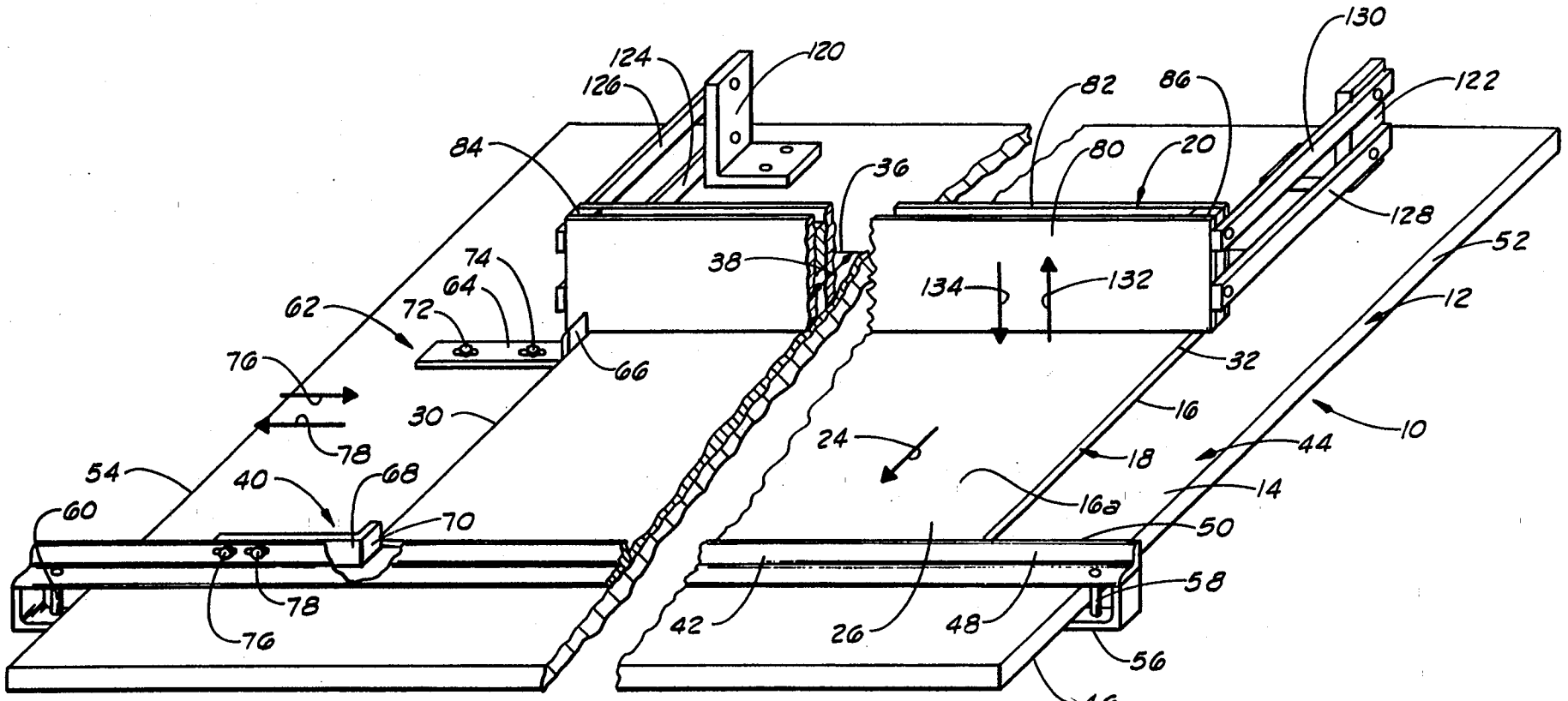
FIG. 1 is a partial perspective view of a material dispenser constructed in accordance with the present invention.
Figure 2:
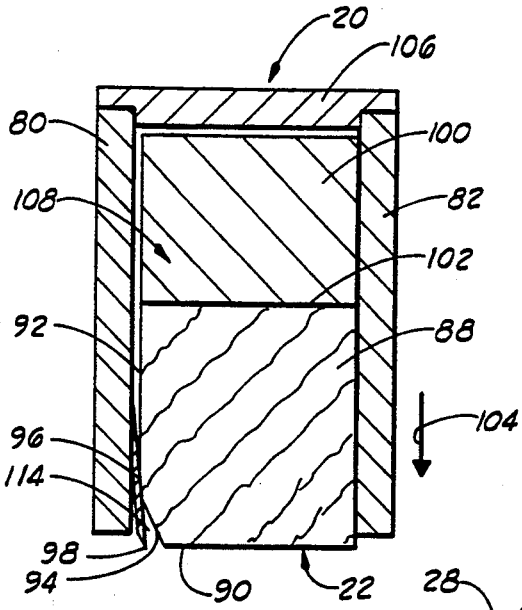
FIG. 2 is a sectional view of the adhesive applicator of the material dispenser shown in FIG. 1.

Shown in FIG. 1 and designated therein by the general reference numeral 10 is a material dispenser constructed in accordance with the present invention. The material dispenser basically comprises a material support 12 having a support surface 14 which is adapted to support a plurality of sheets of material stacked one on top of the other to form a stack of sheets of material (each sheet of material being designated in FIG. 1 by the reference numeral 16 and the stack of sheets of material being designated in FIG. 1 by the general reference numeral 18) and an adhesive applicator 20 having a contact portion 22 (FIG. 2). The stack of sheets of material 18 has a top sheet of material 16*a* which is the sheet of material 16 disposed on top of the stack of sheets of material 18. The contact portion 22 of the adhesive applicator 20 has adhesive therein and the contact portion 22 contactingly engages a portion of the top sheet of material 16*a*.

In operation, the operator grips the top sheet of material 16*a* and pulls the top sheet of material 16*a* in a direction 24, thereby pulling the top sheet of material 16*a* generally through or under the adhesive applicator 20. As the top sheet of material 16*a* is pulled through the adhesive applicator 20, the contact portion 22 contactingly engages the top sheet of material 16*a* being passed therethrough and applies adhesive to the top sheet of material 16*a* thereby providing a sheet of material 16*a* with adhesive applied to one edge thereof and causing the next sheet of material 16 in the stack of sheets of material 18 to form a new or another top sheet of material 16*a*.

Each sheet of material 16 has an upper surface 26, a lower surface 28 (FIG. 3), a left edge 30, a right edge 32, a front edge 34 (FIG. 3) and a rear edge 36. The stack of sheets of material 18 are positioned on the support surface 14 with a portion of the stack of sheets of material being positioned generally beneath the adhesive applicator 20 so that the contact portion 22 of the adhesive applicator 20 contacts a portion of the upper surface 26 of the top sheet of material 16*a* at a position generally between the front edge 34 and the rear edge 36 and, more particularly, at a position spaced a distance 38 from the rear edge 36 of the top sheet of material 16*a*. Further, the contact portion 22 of the adhesive applicator 20 contacts the upper surface 26 of the top sheet of material 16*a* at a position extending generally between the left and right edges 30 and 32 of the top sheet of material 16*a*. Thus, as the top sheet of material 16*a* is pulled in the direction 24, the adhesive applicator 20 applies adhesive to a portion of the upper surface 26 of the top sheet of material 16*a* generally between the left and the right edges 30 and 32 extending over the distance 38 generally between the contact portion 22 and the rear edge 36 of the top sheet of material 16*a*.

The material support 12 includes a guide assembly 40 which is connected to the support surface 14 and adapted to guidingly position the stack of sheets of material 18 at a predetermined position on the support surface 14 so that the contact portion 22 of the adhesive applicator 20 contacts a predetermined portion of the upper surface 26 of the top sheet of material 16*a* at the position spaced the distance 38 from the rear edge 32 of the top sheet of material 16*a*. The guide assembly 40 comprises a front edge guide 42 which is movably connected to the support surface 14. More particularly, the material support 12 includes a table 44 with the support surface 14 formed on a portion of the table 44 and the table 44 has a lower surface 46.

The front edge guide comprises a top bar 48 having a front edge guide surface 50 positioned on the support surface 14 and extending generally between opposite sides 52 and 54 of the table 44. The front edge guide 42 also includes a lower bar 56 which is positioned generally on the lower surface 14 of the table 44 and extends generally between the opposite sides 52 and 54 of the table 44. The top bar 48 is connected to the lower bar 56 via a pair of bolts 58 and 60.

In operation, the bolts 58 and 60 each are loosened and the top bar 48 and lower bar 56 are slidingly moved on the table 44 to position the front edge guide surface 50 at a predetermined position for engaging the front edge 34 of the stack of sheets of material 18 for positioning the stack of sheets of material 18 in a predetermined position in one direction.

The guide assembly 40 also includes a left edge guide 62 which is positioned on the support surface 14 for engaging the left edges 30 of the sheets of material 16 in the stack of sheets of material 18 for positioning the stack of sheets of material 18 on the support surface 14 in one other direction. The left edge guide 62 comprises a first guide plate 64 having a left edge guide surface 66 and a second guide plate 68 having a left edge guide surface 70. The first guide plate 64 is movably and adjustably supported on the support surface 14 of the table 44 via a pair of bolts 72 and 74 so that the bolts 72 and 74 may be loosened and the first guide plate 64 moved in a direction 76 or 78 to adjustably position the left edge guide surface 66. The second guide plate 68 is movably and adjustably supported on the top bar 48 via a pair of bolts 76 and 78 so that the bolts 76 and 78 may be loosened and the second guide plate 68 moved in the direction 76 or 78 to adjustably position the left edge guide surface 70 on the support surface 14 of the table 44. The left edge guide surfaces 66 and 70 of the first and the second guide plates 64 and 66 each engage the left edges 30 of the sheets of material 16 and the stack of sheets of material 18 for positioning the stack of sheets of material 18 in one direction on the support surface 14 of the table 44.

As shown in FIGS. 1 and 2, the adhesive applicator 20 comprises a first plate 80 and a second plate 82. The first and the second plates 80 and 82 each extend a distance generally between the left and the right edges 30 and 32 of the sheets of material 16 and the stack of sheets of material 18. The plates 80 and 82 each extend a distance generally beyond the left and the right edges 30 and 32 of the sheets of material 16 in the stack of sheets of material 18. An end plate 84 is disposed generally between one end of the first plate 80 and one end of the second plate 82 and the end plate 84 is secured to the first and the second plates 80 and 82. An end plate 86 is disposed between the first and the second end plates 80 and 82 generally between the ends of the first and the second end plates 80 and 82 opposite the ends having the end plate 84 connected thereto. The end plate 86 is secured to the first and the second end plates 80 and 82.

A felt pad 88 (FIG. 2) is disposed between the first and the second end plates 80 and 82. The felt pad 88 is sometimes referred to herein as a "an adhesive pad". The felt pad 88 extends generally between the opposite ends of the first and the second end plates 80 and 82. A portion of the felt pad 88 extends a small distance beyond the lower ends of the end plates 80 and 82 terminating with an end 90 (FIG. 2) of the felt pad 88. The end 90 of the felt pad 88 forms the contact portion 22 of the adhesive applicator 20. The felt pad 88 is constructed and adapted to absorbingly hold a quantity of adhesive.

As shown in FIG. 2, a side 92 of the felt pad 88 is spaced a distance from the first plate 80 and a portion of the side 92 of the felt pad 88 generally near the end 90 thereof is beveled to form a beveled edge 94.

One end of a knife 96 is secured to the first plate 80. The knife 96 is disposed generally between the side 92 of the felt pad 88 and the first plate 80. The knife 96 extends a distance from the end plates 80 and 82 terminating with a knife edge 98 which is spaced a distance from the lower ends of the first and the second plates 80 and 82. The knife edge 98 is disposed in a plane about coplanar with the end 90 of the felt pad 88.

A weight 100 (FIG. 2) is disposed between the first and the second end plates 80 and 82. The weight 100 is disposed generally on an upper end 102 of the felt pad 88. The weight 100 biases the felt pad 88 in a generally downwardly direction 104 generally toward the top sheet of material **16*a* for assuring that the contact portion 22 (end 90) maintains contacting engagement with the top sheet of material 16*a* in the stack of sheets of material 18. The weight 100 provides a means for biasing the contact portion 22 (end 90 of the felt pad 88) into engagement with the top sheet of material 16*a* whereby the contact portion 22 biasingly moves into engagement with the top sheet of material 16*a* as the top sheet of material 16*a* is removed from the stack of sheets of material 18**.

A cover 106 is connected to the upper ends of the first and the second plates 80 and 82. The cover 106 extends generally between the opposite sides of the first and the second plates 80 and 82. The cover 106 cooperates with the first and the second plates 80 and 82 to substantially enclose a space 108 in the adhesive applicator 20 for substantially preventing the evaporation of adhesive.

The first and the second plates 80 and 82, the end plates 80 and 84 and the cover 106 cooperate to form an adhesive housing 110 having the housing space 108 formed in a portion thereof and a housing thereof 112 formed through a lower end thereof.

A pair of support post 120 and 122 each are secured to the support surface 14 of the table 44. The support post 120 and 122 are spaced a distance apart. The support post 120 is generally aligned with one end of the adhesive housing 110 and the support post 122 is generally aligned with the opposite end of the adhesive housing 110. A pair of struts 124 and 126 are connected between the support post 120 and the adhesive housing 110 and a pair of struts 128 and 130 are connected between the support post 122 and the opposite end of the adhesive housing 110. One end of each of the support struts 124 and 126 is pivotally connected to the support post 120 and the opposite ends of the struts 124 and 126 are pivotally connected to the adhesive housing 110. One end of each of the struts 128 and 130 is pivotally connected to the support post 122 and the opposite ends of the 128 and 130 are pivotally connected to the adhesive housing 110.

The connection of the struts 124, 126, 128 and 130 between the support posts 120 and 122, respectively, and the adhesive housing 110 permit the adhesive housing 110 to be moved in the upward direction 132 or the downward direction 134 to accommodate different thicknesses of stacks of sheets of material 18 while maintaining the end 90 of the felt pad 88 disposed in a plane generally coplanar with the planer disposition of the top sheet of material **16*a* or the support surface 14 of the table 44 or, in other words, while maintaining the adhesive housing 110 extending in a direction generally perpendicular to the support surface 14 of the table 44**.

In operation, the adhesive housing 110 is moved in the upward direction 132 and the stack of sheets of material 18 is positioned on the support surface 14 of the table 44. The adhesive housing 110 then is moved in the downward direction 134 to a position wherein the end 90 (contact portion 22) engages the top sheet of material **16*a*. The top sheet of material 16*a* then is gripped by an individual and pulled in the direction 24. As the top sheet of material 16*a* is pulled in the direction 24, the contact portion 22 (end 90) of the felt pad 88 contactingly engages a portion of the top sheet of material 16*a* and applies adhesive thereto as the top sheet of material 16*a* is passed beneath the housing 110, thereby providing a top sheet of material 16***a* having adhesive formed on a portion thereof generally near the rear edge 36 and spaced a distance therefrom.

As the sheet of material 16*a* is pulled and passed under the adhesive applicator 20, the contact portion 22 of the adhesive applicator 20 applies adhesive to the sheet of material 16*a*. The knife edge 98 of the knife 96 is positioned to contact the sheet of material 16*a* after adhesive has been applied to the sheet of material 16*a* via the adhesive applicator 20. As the sheet of material is passed or pulled under the adhesive applicator 20, the knife contacts the sheet of material and removes a portion of the adhesive applied via the adhesive applicator 20 so that the sheet of material 16*a* has a relatively thin even film of adhesive applied thereto as the sheet of material is passed from the under the knife edge 98.

The adhesive removed from the sheet of material 16*a* via the knife 98 passes upwardly between the knife 98 and a portion of the felt pad 88 generally near the end 90 (contact portion 22) into a space 114 generally between the knife 96 and the felt pad 88. As adhesive continues to be removed from the sheet of material 16*a* via the knife 96, the adhesive is forced upwardly through the space 114 and into engagement with the portion of the felt pad 88 which is in engagement with the knife 96 and the felt pad 98 reabsorbs the excess adhesive.

In one preferred embodiment, the sheet of material 16 having adhesive applied near the rear edge 36 thereof is utilized to wrap a floral grouping. The term "Floral grouping" as used herein means cut fresh flowers, artificial flowers, other fresh and/or artificial plants or other floral materials and may include other secondary plants and/or ornamentation which add to the aesthetics of the overall floral grouping.

Figure 3:
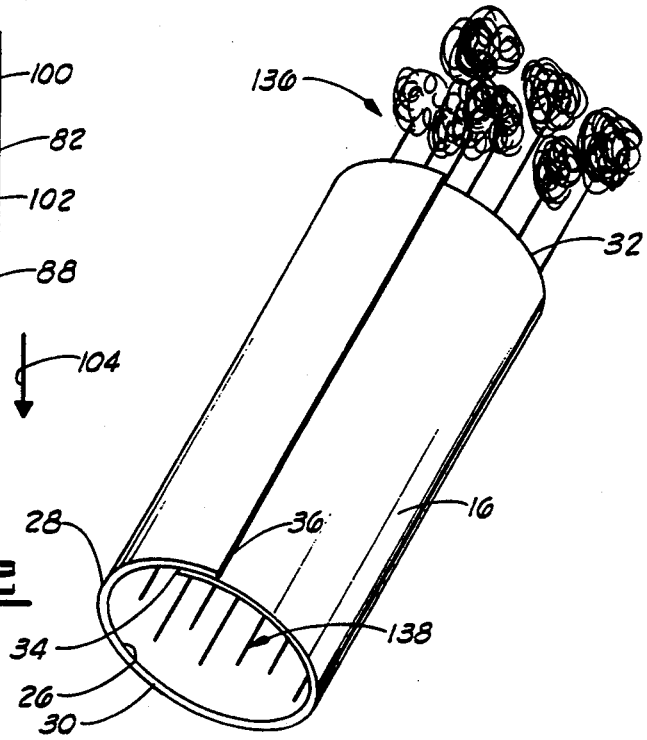
FIG. 3 is a diagrammatic, partial elevational view of a sheet of material after the adhesive has been applied thereto and wrapped about a floral grouping, the sheet of material being held securely about the floral grouping by adhesively connecting one end portion of the sheet of material to another portion of the sheet of material.

As shown in FIG. 3, a bunch of flowers 136 (floral grouping) having stems 138 is wrapped with a sheet of material 16 having adhesive applied to a portion thereof in the manner described before. The sheet of material 16 is wrapped generally about the stems 138 to a position wherein the front edge 34 generally overlaps the rear edge 36. It should be noted that the sheet of material 16 may be wrapped a plurality of times about the stems 138 before the overlapping of the front edge 34 and the rear edge 36. In this position, the portion of the sheet of material 16 near the rear edge 36 thereof having the adhesive thereon is disposed generally adjacent another portion of the sheet of material 16 and the two adjacent portion then are brought into contact and adhesively connected, thereby securing the sheet of material 16 generally about the floral grouping shown in FIG. 3.

The material dispenser 10 is located near the place where the floral groupings are located. It is contemplated that the adhesive is applied to the sheet of material 16 and the sheet of material 16 then is wrapped about the floral grouping in a continuous process.

EMBODIMENT OF FIGURE 4

Figure 4:
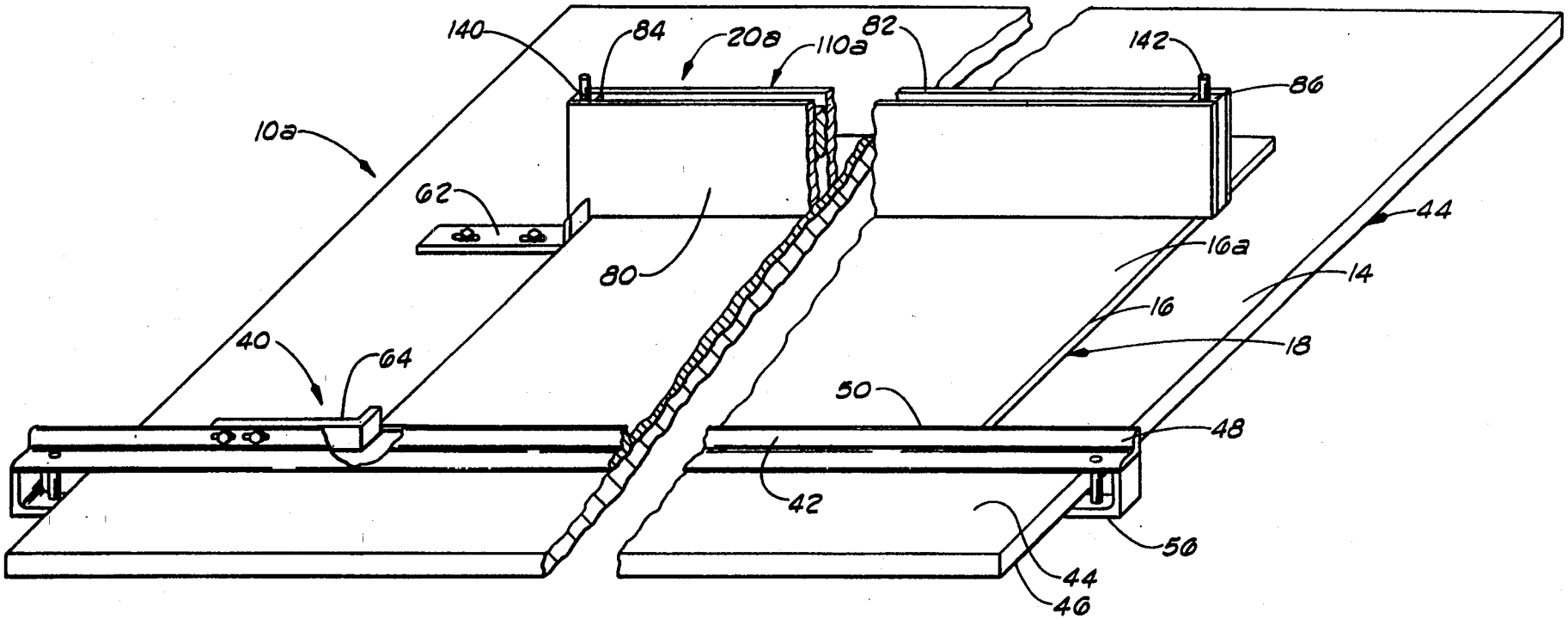
FIG. 4 is a partial perspective view, similar to FIG. 1, but showing a modified material dispenser.

Shown in FIG. 4 is a modified material dispenser 10*a* which is constructed exactly like the material dispenser 10 described in detail before, except the material dispenser 10*a* includes a modified adhesive applicator 20*a*. The modified adhesive applicator 20*a* is constructed exactly like the adhesive applicator 20 described in detail before, except the modified adhesive applicator 20*a* includes an opening extending through and intersecting the opposite ends in each of the end plates 84 and 86. One end of a support rod 140 is secured to the support surface 14 of the table 44 and the support rod 140 extends a distance generally perpendicular upwardly from the support surface 14. One end of a support rod 142 is secured to the support surface 14 and the support rod 142 extends a distance generally perpendicularly upwardly from the support surface 14. The adhesive housing 110*a* is positioned generally over the support rods 140 and 142 and the adhesive housing 110 then is lowered in the general direction 134 over the support rods 140 and 142 with the support rods 140 and 142 being slidingly disposed in the openings through the end plates 84 and 86, respectively.

The support rods 140 and 142 thus slidingly support the adhesive housing 110*a* on the support surface 14 of the table 44 so that the adhesive housing 110*a* is movable in the direction 134 and in the direction 132. The support rods 140 and 142 each slidingly support the adhesive housing 110 for movement in the directions 134 and 132 to accommodate different thicknesses of stacks of sheets of material 18 in a manner similar to that described before with respect to the support post 120 and 122 and the interconnected struts 124, 126, 128 and 130.

EMBODIMENT OF FIGURE 5

Figure 5:
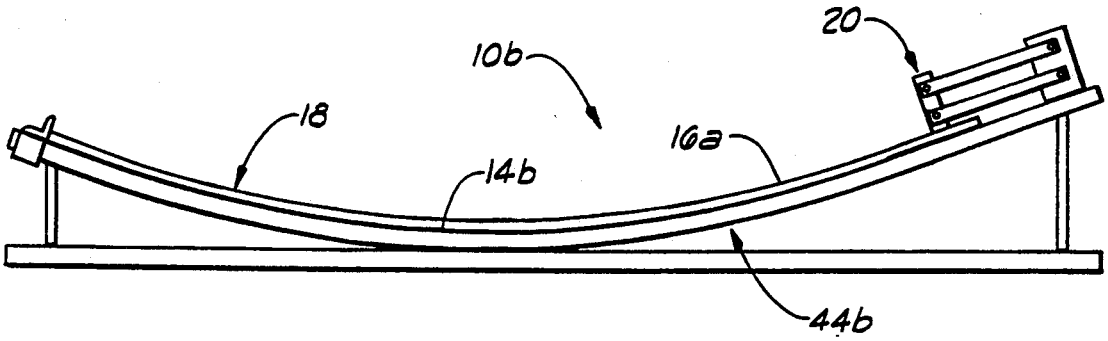
FIG. 5 is a side elevational view of a modified material dispenser, similar to the material dispenser of FIG. 1, but showing a curved material support base.

Shown in FIG. 5 is another modified dispenser 10*b*. The modified dispenser 10*b* is constructed exactly like the material dispenser 10 described in detail before, except the support surface 14*b* of the table 44*b* is formed on a curved path to facilitate the wrapping of a floral grouping in the manner like that described before with respect to FIG. 3.

EMBODIMENT OF FIGURE 6

Figure 6:
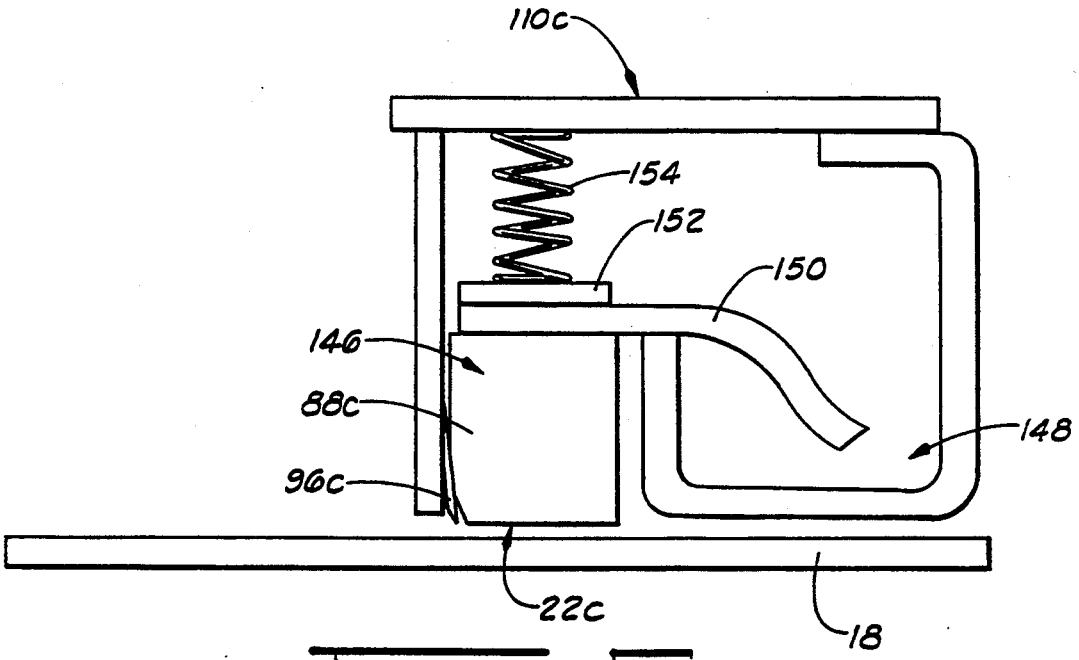
FIG. 6 is a modified adhesive applicator which may be used with the material dispensers of FIGS. 1, 4, 5 and 7.

Shown in FIG. 6 is a modified adhesive housing 110*c* which may be used in lieu of the adhesive housings 110 and 110*a* described before.

The modified adhesive housing 110*c* encompasses a pad space 146 and has an adhesive space 148. A felt pad 88*c* is disposed in the pad space 146 and a knife 96*c* is connected to a portion of the adhesive housing 110*c* and disposed near the felt pad 88*c* in a manner like that described before with respect to the felt pad 88 and the knife 96.

One end of a wick 150 is disposed generally on the upper end of the felt pad 88*c* and the opposite end of the wick 150 is disposed generally within the adhesive space 148.

A bias plate 152 is disposed on a portion of the wick 150 generally above the felt pad 88. One end of a spring 154 is connected to the bias plate 152 and the opposite end of the spring is connected to a portion of the wick 150. The spring 154 biases the felt pad 88 downwardly toward the stack of sheets of material 18 for maintaining engagement between the contact portion 22*c* and the top sheet of material in the stack of sheets of material 18.

EMBODIMENT OF FIGURE 7

Figure 7:
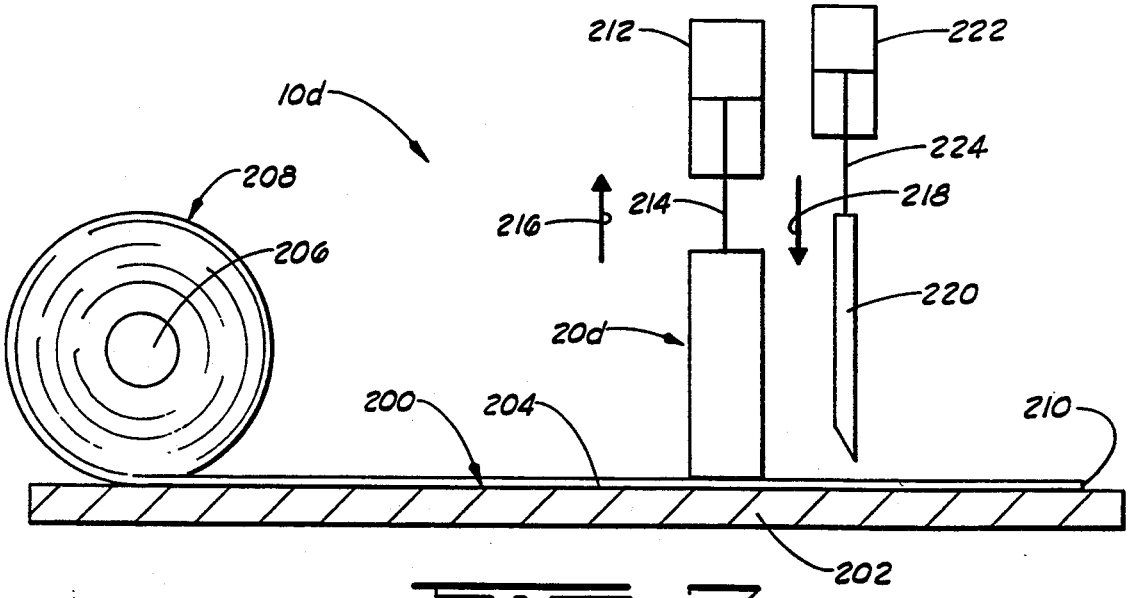
FIG. 7 is a schematic, diagrammatic view of another modified material dispenser.

Shown in FIG. 7 is a modified material dispenser 10*d* which includes an adhesive applicator 20*d*. The adhesive applicator 20*d* is constructed exactly like the adhesive applicator 20 or 20*c* described in detail before.

The material dispenser 10*d* includes a material support 200 comprising a table 202 with a support surface 204 and a rod 206 which is supported in a position generally spaced a distance above the support surface 204. A roll of material 208 is supported on the rod 206. The roll of material has a leading end 210.

The material dispenser 10*d* includes a hydraulic cylinder 212 having a cylinder rod 214 reciprocatingly disposed therein. One end of the cylinder rod 214 is connected to the adhesive applicator 20*d*. The hydraulic cylinder 212 is connected to a fluid or air supply for operating the hydraulic cylinder 212 to move the cylinder rod 214 and the adhesive applicator 20*d* connected thereto in an upward direction 216 or in a downward direction 218.

The material dispenser 10*d* also includes a knife 220 and another hydraulic cylinder 222 having a cylinder rod 224 reciprocatingly disposed therein. One end of the cylinder rod 224 is connected to the knife 220. The hydraulic cylinder 222 is connected to a fluid or air supply for controlling the hydraulic cylinder 222 to move the cylinder rod 224 and the knife 220 connected thereto in the direction 216 or the direction 218.

In operation, the hydraulic cylinder 212 is actuated to move the adhesive applicator in the direction 216 to a position wherein the adhesive applicator 20*d* is disposed a distance above the support surface 204 of the table 202. In a similar manner, the hydraulic cylinder 222 is actuated to move the knife 220 in the direction 216 to a position wherein the knife 220 is space a distance above the support surface 204 of the table 202. In this position of the adhesive applicator 20*d* and the knife 220, an individual grips the leading end 210 of the roll of material 208 and unrolls material from the roll of material 208 passing the material generally between the adhesive applicator 20*d*, the knife 220 and the support surface 204 of the table 202.

After a predetermined amount of material has been unrolled from the roll of material 208, the hydraulic cylinder 212 is actuated to move the adhesive applicator 20*d* in the downward direction 218 to a position wherein the contact portion of the adhesive applicator 20*d* contactingly engages the material disposed under the adhesive applicator 20*d*. In this position of the adhesive applicator 20*d*, the individual pulls the material from the roll of material 208 passing a predetermined amount of material under the adhesive applicator 20*d* and the adhesive applicator 20*d* applies adhesive to the material passed thereunder. After adhesive has been applied to a predetermined length of material via the adhesive applicator 20*d*, the individual then actuates the hydraulic cylinder 212 to move the adhesive applicator 20*d* in the upper direction 216 to a position wherein the adhesive applicator 20*d* again is spaced a distance above the support surface 204 of the table 202 and the material supported thereon. The material then is unrolled from the roll of material 208 thereby passing the length of material to which adhesive has been applied under the knife 220. After the portion of the material having the adhesive applied thereto has been passed under the knife 220, the hydraulic cylinder 222 then is actuated to move the knife 220 in the downward direction 218 to a position wherein the knife 220 cuttingly engages the material disposed thereunder to provide a sheet of material having adhesive applied to a portion thereof in a manner like that described before.

The material can be automatically unrolled from the roll of material 208 via feed rollers for example and the hydraulic cylinders 212 and 222 can be controlled along with the feed rollers to automate the applying of adhesive and cutting process described before.

Although the material dispensers described herein specifically have been described as providing a sheet of material with adhesive thereon for wrapping a floral grouping, the sheets of material with adhesive thereon could be used to wrap other floral items or non-floral items.

The adhesive applicators could be constructed to apply adhesive only to the left edge or the right edge or both the left edge and the right edges of the sheet of material by eliminating the central portion of the adhesive applicator which may be useful in some applications. In addition, the adhesive applicator 20 could be connected to hydraulic cylinders in a manner like described with respect to the adhesive applicator 20*d* shown in FIG. 7 and controlled so that the adhesive applicator 20 is controllingly moved into and out of engagement with the sheet of material to apply adhesive at selective spots or portions on the sheet of material which may be desirable in some applications. Also, the struts 124, 126, 128 and 130 can be connected via a linkage to a foot operated pedal for manually moving the struts thereby moving the adhesive applicator into and out of engagement with the sheet of material for selectively applying the adhesive to selected portions of the sheet of material. In lieu of a foot operate mechanism, the linkage could be powered via a various means.

To assist in transferring the adhesive wiped from the sheet of material via the knife such as the knife 96, the adhesive applicator 20 can comprise two identical adhesive applicators one on top of the other and rotated ninety degrees. In this embodiment the adhesive applicator would be rotatingly mounted so that one portion of the adhesive applicator 20 would contactingly engage the sheet of material and then the adhesive applicator 20 would be rotated so that another portion of the adhesive applicator 20 would contact the material. In this manner, one of the adhesive applicators always is turned upside down to facilitate the drainage of adhesive from the knife toward the felt pad for reabsorbing by the felt pad. The knife 96 also could be movably mounted in the adhesive applicator 20 so that the knife 96 could be moved to wipe against the felt pad for cleaning the adhesive from the knife after the knife had been utilized for wiping excess adhesive from the sheet of material. In one other embodiment, a wick could be placed on the knife and the excess adhesive could be wicked back onto the main felt pad.

The adhesive applicator can be constructed in various sizes and shapes to put different patterns and amounts of adhesives on the sheet of material. Utilizing different combinations of shapes of the felt pad 88, lifting of the adhesive applicator into and out of engagement with the sheet of material and varying the direction of the pull of sheet of material under the adhesive applicator, the adhesive pattern placed on the sheet of material can be spots, bars, stripes, swirls, circles or any other specific pattern. The adhesive pattern placed on the sheet of material can be adapted to facilitate any special wrap or package shape for example the adhesive pattern could placed on all edges of the sheet of material, across the sheet of material diagonally and various other patterns. Also, the pattern of adhesive on the sheet of material could be placed on the sheet of material so as to miss or correspond to special printing on the sheet of material. In addition, pigments and/or glitter could be added to the adhesive to obtain different or various visual or aesthetic affects.

The adhesive housing 110 is substantially enclosed to prevent premature drying of the adhesive in the adhesive housing 110. This allows the use of faster drying and stronger adhesive.

The adhesive housing 110c shown in FIG. 6 could be adapted so that when the adhesive housing 110c is tilted adhesive from the adhesive space 148 is flowed or passed onto the felt pad 88c in lieu of the wick 150 arrangement as shown in FIG. 6. In this embodiment excess adhesive would be drained back into the adhesive space 148. In another embodiment, a sight glass or transparent tube can be utilized to feed adhesive to the felt pad thereby enabling the operator to judge the amount of adhesive being transferred by sight.

In one other embodiment, balls could be utilized for forming the contact portions of the adhesive applicator in lieu of the pads described herein. In this embodiment, the balls would roll the adhesive onto the material being passed thereunder. In lieu of balls or pads, rollers, brushes, sprays or hot melts also could be utilized for applying the adhesive. The material dispensers described herein also could be utilized for applying substances to the sheet to give the sheet of material aesthetic cling capability in lieu of applying an adhesive which may also be useful in some applications.

Changes may be made in the various components, elements and assemblies described herein and changes may be made in the steps or sequence of steps of the methods described herein without departing from the spirit and scope of the invention as defined in the following claims.

What is claimed is:

1. A method for wrapping a floral grouping having a stem end and a flower end, comprising:

providing a sheet of material having an upper surface and a lower surface; and passing at least a portion of the sheet of material through an adhesive applicator which applies an adhesive to at least one of the upper and the lower surfaces thereof;

wrapping the sheet of material about the floral grouping to a position wherein the portion of the sheet of material having the adhesive thereon contacts another portion of the sheet of material for adhesively connecting the sheet of material and securing the sheet of material about the floral grouping, the sheet of material substantially encompassing and surrounding a substantial portion of the stem end of the floral grouping with the sheet of material wrapped about the floral grouping, the sheet of material being loosely wrapped about the flower end of the floral grouping.

2. The method of claim 1 wherein the steps of passing and wrapping are in a continues process.

3. A method for wrapping a floral grouping, comprising:

providing a roll of material wherein the material has an upper surface and a lower surface;

unrolling material from the roll of material passing at least a portion of the sheet of material from the roll of material through an adhesive applicator wherein the adhesive applicator applies adhesive to at least one of the upper and lower surfaces of the sheet of material;

cutting a sheet of material from the roll of material after adhesive has been applied to the materials; and wrapping the sheet of material about the floral grouping to a position wherein the portion of the sheet of material having the adhesive thereon contacts another potion of the sheet of material for adhesively connecting the sheet of material in securing the sheet of material about the floral grouping, the sheet of material substantially encompassing and surrounding a substantial portion of the stem end of the floral grouping and the sheet of material being loosely wrapped about the flower end of the floral grouping.

4. The method of claim 3 wherein the steps of unrolling, passing, cutting and wrapping are in a continuous process.

* * * * *

UNITED STATES PATENT AND TRADEMARK OFFICE

CERTIFICATE OF CORRECTION

PATENT NO. : 5,408,802

DATED : April 25, 1995

INVENTOR(S) : Weder et al.

It is certified that error appears in the above-identified patent and that said Letters Patent is hereby corrected as shown below:

Column 2, line 46, please delete "rear edge 32" and substitute therefor -- rear edge 36 --.

Column 2, line 58, please delete "lower surface 14" and substitute therefor -- lower surface 46 --.

Column 3, line 16, two occurrences, please delete "bolts 76 and 78" and substitute therefor -- bolts 72 and 74 --.

Column 3, line 21, please delete "second guide plates 64 and 66" and substitute therefor -- second guide plates 64 and 68 --.

Column 3, line 45, please delete the word "a".

Column 4, lines 21-22, please delete "end plates 80 and 84" and substitute therefor -- end plates 84 and 86 --.

Column 4, line 24, please delete "112".

Column 4, line 26, please delete "post" and substitute therefor -- posts --.

Column 4, line 28, please delete "post" and substitute therefor -- posts --.

UNITED STATES PATENT AND TRADEMARK OFFICE

CERTIFICATE OF CORRECTION

PATENT NO. : 5,408,802

DATED : April 25, 1995

INVENTOR(S) : Weder et al.

It is certified that error appears in the above-identified patent and that said Letters Patent is hereby corrected as shown below:

Column 4, line 42, before "128 and 130" please insert -- struts --.

Column 5, line 18, two occurrences, please delete "knife 98" and substitute therefor -- knife 96 --.

Column 5, line 26, please delete "felt pad 98" and substitute therefor -- felt pad 88 --.

Column 5, line 29, please delete "Floral" and substitute therefor -- floral --.

Column 5, line 48, please delete "portion" and substitute therefor -- portions --.

Column 6, line 20, please delete "post" and substitute therefor -- posts --.

Column 7, line 24, please delete "space" and substitute therefor -- spaced --.

Column 8, line 6, please delete "edges" and substitute therefor -- edge --.

Column 8, line 22, please delete "operate" and substitute therefor -- operated --.

UNITED STATES PATENT AND TRADEMARK OFFICE

CERTIFICATE OF CORRECTION

PATENT NO. : 5,408,802

DATED : April 25, 1995

INVENTOR(S) : Weder et al.

It is certified that error appears in the above-identified patent and that said Letters Patent is hereby corrected as shown below:

Column 8, line 23, please delete the word "a".

Column 8, line 56, after "shape" please insert --,--.

Column 8, line 57, after "could" please insert -- be --.

Column 8, line 64, please delete "affects" and substitute therefor -- effects --.

Column 10, line 11, please delete "continues" and substitute therefor -- continuous --.

Column 10, line 16, after "roll of material" please insert --;--.

Column 10, line 28, please delete "potion" and substitute therefor -- portion --.

Signed and Sealed this

Nineteenth Day of September, 1995

*Attest:*

Bruce Lehman

BRUCE LEHMAN

*Attesting Officer*

*Commissioner of Patents and Trademarks*